United States Patent [19]

Shimoda

[11] 4,197,765

[45] Apr. 15, 1980

[54] DIAL APPARATUS

[75] Inventor: Eitaro Shimoda, Tokyo, Japan

[73] Assignee: Sakae Tsushin Kogyo Co. Ltd., Japan

[21] Appl. No.: 782,369

[22] Filed: Mar. 29, 1977

[30] Foreign Application Priority Data

Oct. 18, 1976 [JP] Japan ..... 51-139946[U]

[51] Int. Cl.[2] ..... G05G 1/10

[52] U.S. Cl. ..... 74/553; 74/5 F; 116/309

[58] Field of Search ..... 74/553, 5 F; 116/114, 116/133, 129 R, 129 F; 133/172 R, 146, 147 R, 139

[56] References Cited

U.S. PATENT DOCUMENTS

| | | | |
|---|---|---|---|
| 976,187 | 11/1910 | Krebs | 74/5 F X |
| 1,947,282 | 2/1934 | Theis | 74/553 |
| 2,502,915 | 4/1950 | Atkins et al. | 74/553 |
| 2,667,084 | 1/1954 | McNamara | 74/553 X |
| 3,064,494 | 11/1962 | Brewster | 74/553 X |
| 3,342,082 | 9/1967 | Davidson | 74/553 |
| 4,012,806 | 3/1977 | Howie, Jr. | 74/553 X |
| 4,050,265 | 9/1977 | Drennen et al. | 74/553 X |

FOREIGN PATENT DOCUMENTS

| | | | |
|---|---|---|---|
| 89172 | 9/1958 | Netherlands | 74/553 |

*Primary Examiner*—James C. Yeung
*Assistant Examiner*—Daniel O'Connor
*Attorney, Agent, or Firm*—Hill, Van Santen, Steadman, Chiara & Simpson

[57] ABSTRACT

A rotary support device for use with a dial apparatus is disclosed. The rotary support device is formed mainly of a first cylinder having an aperture through which a rotary shaft of the dial apparatus passes, the rotary shaft being then fixed thereto, a second cylinder having an aperture through which the rotary shaft passes with a clearance therebetween, and a coupling member which resiliently couples the first and second cylinders. The second cylinder is coupled to a rotating member of the dial apparatus and they are to be rotated together, so that when the rotating member of the dial apparatus is rotated, the rotary shaft of the dial apparatus is rotated through the second cylinder, the coupling member and the first cylinder even if the axis of the rotary shaft is eccentric to the axes of the support cylinders.

5 Claims, 14 Drawing Figures

DIAL APPARATUS

BACKGROUND OF THE INVENTION

1. Field of the Invention

This invention relates mainly to a rotary support device, and particularly to a rotary support device suitable for use with a rotary dial apparatus for a potentiometer or the like in which a rotary shaft of the potentiometer extends into the aperture of a rotating member of the rotary dial apparatus for the adjustment of resistance value, by way of example.

2. Description oft the Prior Art

A prior art rotary dial apparatus attached to a potentiometer will hereinafter be described with reference to FIG. 1. In the FIG. 1, designates a panel for mounting a driven member such as a potentiometer 2, 3 a rotary shaft engaged with a sliding contact (not shown) of the potentiometer 2 and projecting above the panel 1 through a fixed shaft collar 4 of the potentiometer 2, 5 a rotating member or a knob of the dial apparatus, and 6 a cylindrical bed on which there are mounted the knob 5 with a rotation scale plate 18, a driven gear 13 with a rotation indicator 17, and a disc 11. The rotary shaft 3 is defined by the shaft collar 4 and a hub nut 70 so as not to be axially moved. The knob 5 has integrally provided therein a cylinder 7 for rotatably supporting the shaft 3. When the knob 5 is rotated the cylinder 7 and the shaft 3 are rotated as will be described below and hence the sliding contact in the potentiometer 2 is rotated by the shaft 3 to obtain various resistance values.

That is, the knob 5, accordingly the cylinder 7, is adapted to rotate integrally with the shaft 3 by means of screws 9 which are inserted through side bores 8 of the knob 5 to be screwed through the cylinder 7 to the shaft 3 from, for example, three directions.

Next, the rotary dial apparatus will be further described. In FIG. 1, inner teeth 10 are partially provided at the lower inner peripheral surface of the knob 5, while a disc 11 is fixedly mounted on the cylindrical bed 6 and a pinion 12 is rotatably provided on the disc 11 projecting therefrom. The pinion 12 is meshed with the inner teeth 10 of the knob 5 and also with inner teeth 14 of the driven gear 13 which is co-axially and rotatably mounted on the disc 11. A cover 15 is mounted on the bed 6 in a manner of covering the fixed portions, bed 6 and disc 11, and the rotary portions, driven gear 13 and lower part of knob 5. Thus, the rotation indicator 17 may indicate the number of rotations of the knob 5, accordingly the shaft 3, on the exterior surface of the driven gear 13 through a window 16 of the cover 15. The number of rotation of the knob 5, hence the shaft 3, and its rotated angle can be known by looking at the aforementioned indicated number of rotation and also the indication of the rotation scale plate 18 provided on the knob 5.

Further, 19 indicates a snap ring which is provided between the cylinder 7 and the disc 11 for axially fixing the cylinder 7, accordingly the knob 5, and the driven gear 13 by inserting it in the lower projecting end portion of the cylinder 7 which passes through the driven gear 13 and the disc 11. Reference numeral 20 represents a fixing plate which is engaged with the shaft collar 4 and fastened to the panel 1 by the hub nut 70 so that the panel 1 may be held between the fixing plate 20 and the potentiometer 2. One end of the fixing plate 20 is bent down and inserted into a hole 21 of the panel 1, while the other end thereof stands up and engages with a projection 22 at the inner side of the bed 6, thus the rotation of the bed 6 being limited or stopped.

With the prior art apparatus as mentioned above, if the knob 5, cylinder 7, driven gear 13, disc 11 and the like are improperly centered or inaccurately finished when assembled the shaft 3 will not smoothly rotate or sometimes will not be rotatable so that the apparatus may be unusable and hence not economical. Accordingly, in such a case, temporary procedures are taken such as to enlarge the axial bores 24 and 24' of the knob 5 and cylinder 7, respectively, for manually adjusting the fastening condition of the screws 9 from three directions or to incline the bed 6 relative to the panel 1. Thus, the proper axial engagements of the shaft 3 and the cylinder 7 with the aforesaid bores 24' and 24 were barely achieved so as to make the shaft 3 rotatable and the number of defective members was decreased or made minimum. However, the above procedures were not radical and from technical and economical points of view it was unreasonable to enhance the accuracy of finishing of each member.

OBJECTS AND SUMMARY OF THE INVENTION

Accordingly, it is a main object of this invention to provide a rotary support device for use with a dial apparatus which completely removes the prior art drawbacks.

It is another object of this invention to provide a rotary support device for use with a dial apparatus in which the components of the dial apparatus can be easily assembled even though their accuracy is slightly low.

It is a further object of this invention to provide a rotary support device for use with a dial apparatus which permits smooth rotation of a rotary shaft with a simple construction.

According to an aspect of this invention, there is provided a rotary support device for use with a dial apparatus having a rotary shaft, which comprises a first cylinder having an aperture through which a rotary shaft of a dial apparatus passes with a gap therebetween, a screw for fixedly attaching the rotary shaft to the first cylinder, a second cylinder having an aperture for rotatably supporting the rotary shaft therein, the inner diameter of the second cylinder being selected greater than the outer diameter of the rotary shaft so that the rotary shaft is rotatably supported by the second cylinder with a clearance therebetween, a cylindrical bed fixed on a panel of the dial apparatus for rotatably supporting the second cylinder, and a coupling member for coupling the first cylinder to the second cylinder with resiliency, the second cylinder having coupling devices for rotatably coupling the second cylinder to a rotary knob of the dial apparatus so that when the rotary knob is rotated the rotation of the rotary knob is transmitted to the rotary shaft through the coupling devices, the second cylinder, the coupling member, and the first cylinder to rotate the rotary shaft.

The other objects, features and advantages of this invention will be apparent from the following description taken in conjunction with the accompanying drawings through which the same reference numerals designate the same elements.

DESCRIPTION OF THE PREFERRED EMBODIMENTS

Figure 1:
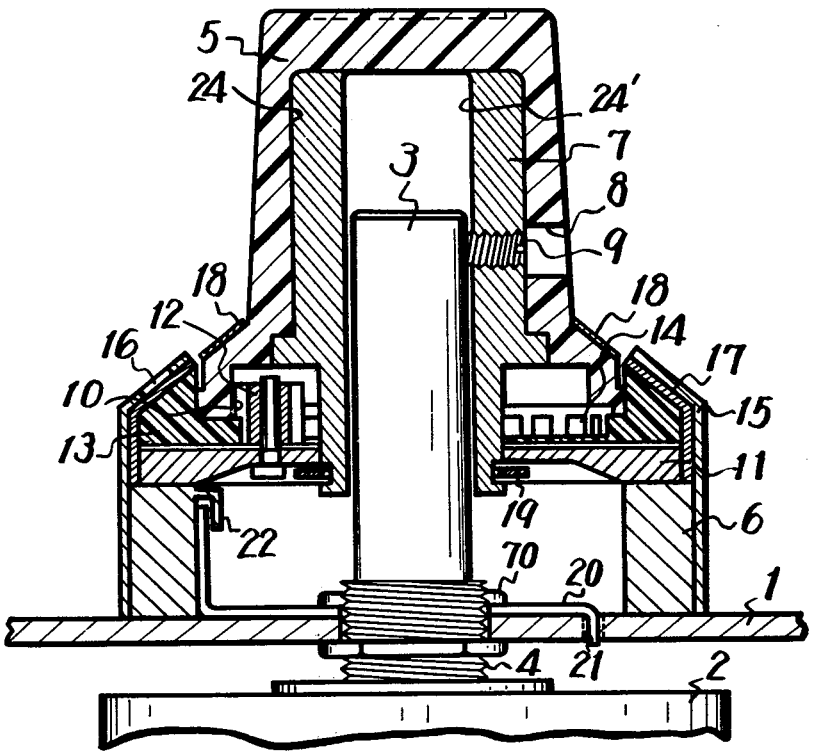
Fig. 1 (PRIOR ART)
FIG. 1 is a vertical sectional view showing a dial apparatus using a prior art rotary support device.

A description will hereinafter be given on the present invention will reference to the drawings.

In a first embodiment of this invention, a flexible coupling member 30 is attached to the bearing portion of a shaft 3 and the like inside a cover 15 so that the rotation of a knob is indirectly applied to the shaft 3, and an aperture engaged with the shaft 3, or an aperture 24 of the knob 5 has enough room for the shaft 3, that is, the inner diameter of the knob 5 is greater than the outer diameter of the shaft 3 thereby to effect the smooth rotation of the shaft 3.

The above first embodiment will be now described in detail with reference to FIGS. 2 to 5.

Figure 4:
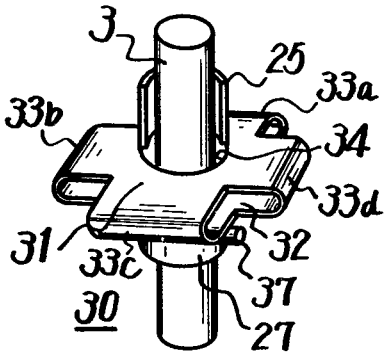
FIG. 4 is a perspective view showing a flexible coupling member shown in FIG. 2.
Figure 5:
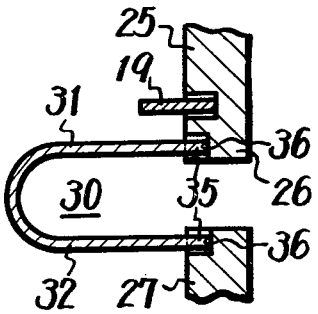
FIG. 5 is an enlarged sectional view showing the main part of the flexible coupling member at its mounted condition.
Figure 3:
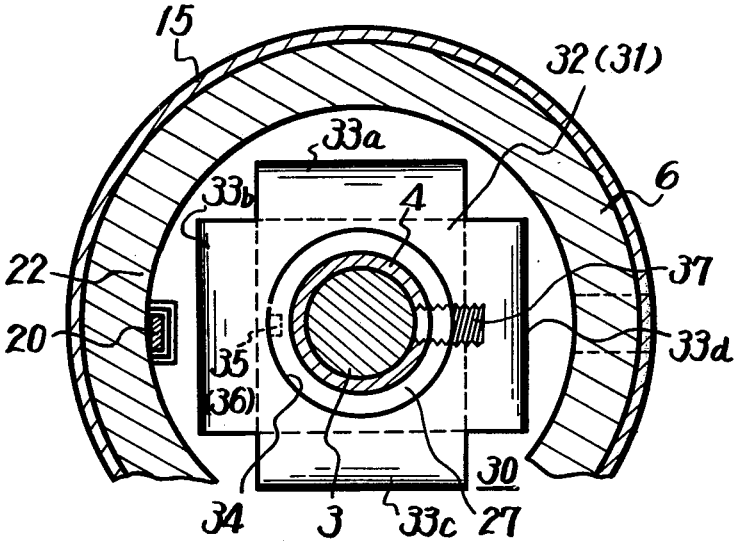
FIG. 3 is a cross sectional view, partially cut away, taken along a line A—A of FIG. 2.
Figure 2:
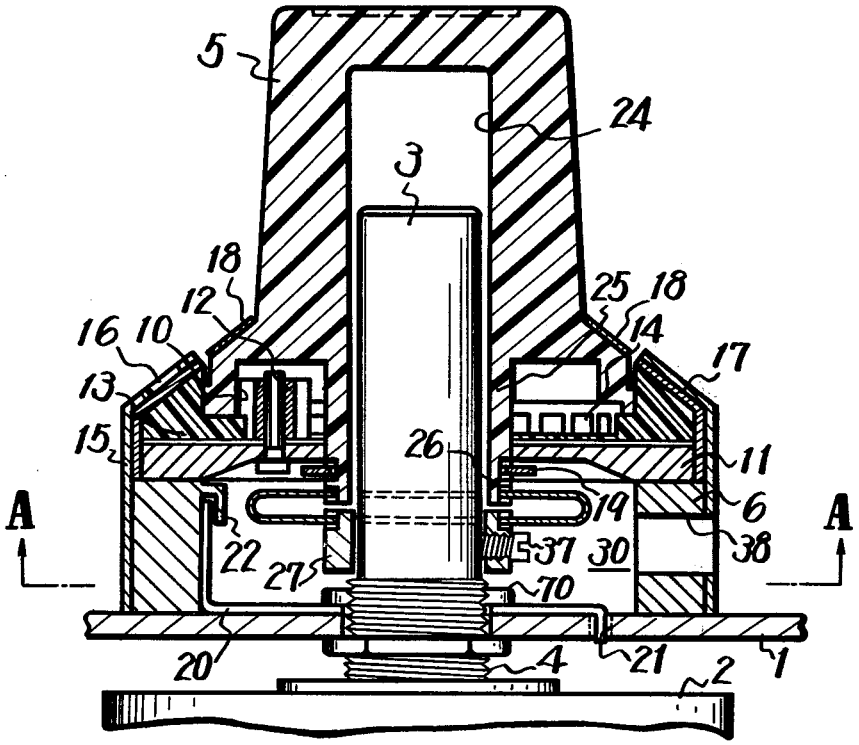
FIG. 2 is a vertical sectional view showing a dial apparatus applied with a first embodiment of the rotary support device of this invention.

FIG. 2 shows a dial apparatus applied with the first embodiment of this invention, in which the flexible coupling member 30 disposed inside the bed 6 consists of an upper and lower plates 31 and 32, each made of resilient thin plate such as a metal, which are of substantially cross shaped and spaced vertically from each other as shown in FIGS. 3 and 4. The upper plate 31 and lower plate 32 having substantially the same shape are each provided with four projecting ends. These four projecting ends of the upper plate 31 are respectively coupled to those of the lower plate 32 and these four coupled portions form resilient bent portions 33*a* to 33*d*. As shown in FIG. 5, the inner end of the lower plate 32 of the flexible coupling member 30 is fixed to a lower sleeve 27 while the inner end of the upper plate 31 is fixed to the lower end portion 26 of a cylinder 25 which is downward extended from the knob 5. The shaft 3 passes through the cylinder 25, the flexible coupling member 30, and the sleeve 27 with a small clearance therebetween to be rotatably supported thereby.

A further detailed description will be given for the above. In FIG. 2, the knob 5 is integrally provided with the cylinder 25 which is downward extended therefrom in its axial direction so as to surround the shaft 3 and axially passed through the driven gear 13 and the disc 11 to form the projecting end portion 26 of the co-axial cylinder 25. A snap ring 19 is then fitted to the end portion 26 of the cylinder 25 to make the driven gear 13 and the disc 11 co-axially integral relative to the shaft 3 in cooperation with the disc 11.

The bent portions 33*a* to 33*d* of the flexible coupling member 30 are resilent to the axial direction of the shaft 3 but a little movable to a direction perpendicularly intersecting the shaft 3, so that both the upper and lower plates 21 and 32 thereof are laterally and vertically movable together or individually. In addition, the upper and lower plates 31 and 32 are respectively provided with an aperture 34 which has a diameter greater than that of the shaft 3 so that the shaft 3 passes therethrough freely as described above. As shown in FIG. 5, the lower projecting end portion 26 of the cylinder 25 and the upper end of the sleeve 27 are respectively provided with a recess 36 while each aperture 34 of the flexible coupling member 30 is provided at its periphery with a projection 35 which is engaged with the corresponding recess 36 so that the end portion 26, the flexible coupling member 30 and the sleeve 27 are integrally rotatable and also movable to the axial direction of the shaft 3. Otherwise, the projecting end portion 26 and the upper plate 31 as well as the upper end of the sleeve 27 and the lower plate 32 may be both welded or bonded to each other at the peripheral edge of each aperture 34. With the above mentioned construction, when the knob 5 is rotated, the flexible coupling member 30 and the sleeve 27 are together rotated and the shaft 3 is rotated by the operation of a screw 37 which will be described later.

According to the above described embodiment of this invention, even though there is center shift among the shaft 3, knob 5 and shaft collar 4, that is, there is center shift between the aperture 24 and the shaft 3 when the components are assembled, since the diameter of the aperture 24 is large enough for that of the shaft 3, that is, the former is about 3.2 mm and the latter is about 3.0 mm by way of example, the shaft 3 can be easily inserted into the aperture 24 and also rotated together with the knob 5 in accordance with its rotation even with the precessional motion of the shaft 3.

In FIG. 2, the screw 37 is screwed into a screw bore of the sleeve 27 through a side window 38 of the bed 6 to fix the sleeve 27 to the shaft 3 so that the sleeve 27 and the shaft 3 can rotate integrally as mentioned above.

A description will next be given on a process of assembling the dial apparatus having the rotary support device constructed as mentioned above. At first, the shaft collar 4 of the potentiometer 2 having the shaft 3 inserted therethrough is screwed to the panel 1 together with the fixing plate 20 by the hub nut 70 so as to fix the potentiometer 2 to the panel 1 as shown in FIG. 2. At the same time, the erected end of the fixing plate 20 is engaged with the projection 22 provided inside the bed 6 while the downward bent portion of the fixing plate 20 is inserted into the hole 21 provided in the panel 1 so that the bed 6 is fixed to the panel 1 to stop its rotation. In this case, the shaft 3 is freely rotatable in accordance with the rotation of the knob 5.

Next, the driven gear 13 and the disc 11, both co-axially engaged with the cylinder 25 of the knob 5, are combined as shown in FIG. 2 and these members are coupled by the snap ring 19 so as not to be axially movable but to be freely rotatable. Then, the flexible coupling member 30 is fixed to the projecting end portion 26 and the sleeve 27 as mentioned above; the shaft 3 is inserted through the sleeve 27, coupling member 30, projecting end portion 26, and cylinder 25; the sleeve 27 is fixed to the shaft 3 by the screw 37; and the disc 11 is bonded co-axially to the upper surface of the bed 6 by, for example, adhesive agent.

In this case, the pinion 12 is meshed with the inner teeth 10 and the driven gear 13, respectively. Then, the respective indications of rotation indicator 17 and rotation scale plate 18 correspond to the rotational position of the shaft 3 of the potentiometer 2. Thereafter, with the cover 15 being mounted, the dial apparatus is assembled.

An operation of the above apparatus will next be described. When the apparatus is assembled with the shaft or other members in an eccentric state as mentioned in the prior art embodiment, the shaft 3 rotates occasionally with creak. In such a case, according to this invention, the above eccentricity can be adjusted by means of the roomy aperture 24 and the coupling member 30. In other words, the upper plate 31 of the coupling member 30 attached to the projecting end portion 26, hence the knob 5, and the lower plate 32 thereof attached to the sleeve 27 are distorted at their bent portions 33*a* to 33*d* to adjust the above eccentricity. Accordingly, the rotation of the knob 5 is smoothly transmitted to the shaft 3 even in an eccentric condition and the shaft 3 can rotate even though it represents a precessional motion in the aperture 24 of the knob 5 with the vicinity of the panel 1 as its center, so that the potentiometer 2 will not spoil its function. In addition, the knob 5 can display its rotation on its outside by the number of rotation and the rotational angle.

As described above, according to the device of this invention, the finishing accuracy of the members through which the shaft 3 passes can be made less than that of the prior art. Further, upon assembling the component members, such temporary measures as mentioned above are unnecessarily taken to eliminate the creaking or binding of shaft 3 and the difficulty of rotation; the function as the dial apparatus for a potentiometer can be sufficiently exhibited; and the whole apparatus is seldom defective resulting in great contribution to the production of dial apparatus.

Figure 6:
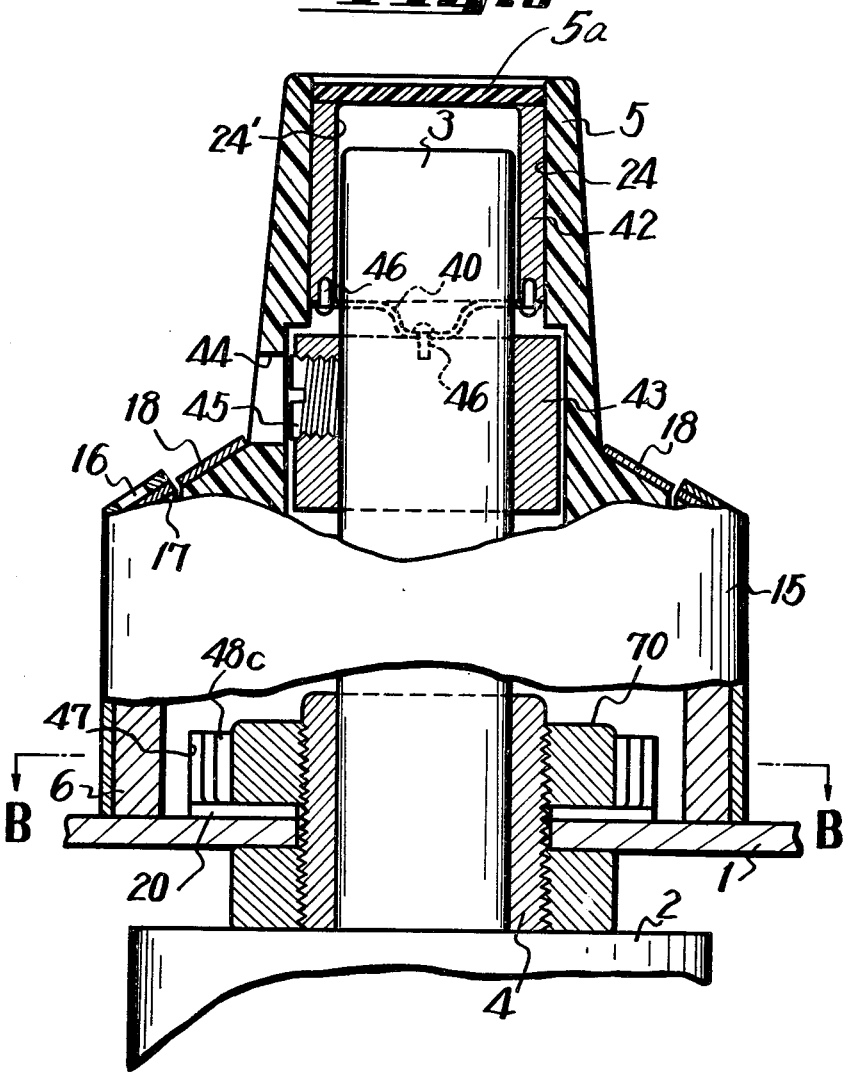
FIG. 6 is a side view, mainly in vertical section, showing a dial apparatus using a second embodiment of this invention.
Figure 7:
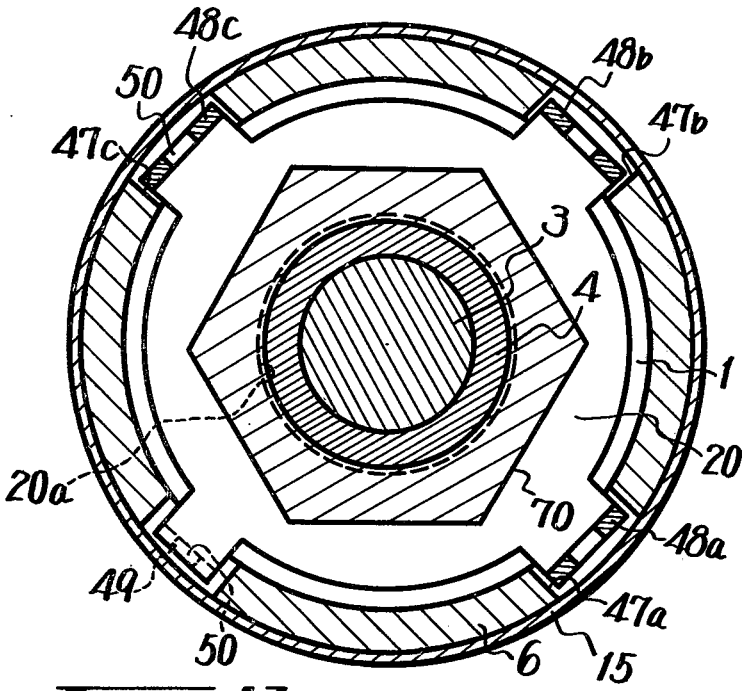
FIG. 7 is a cross sectional view taken along a line B—B of FIG. 6.
Figure 11:
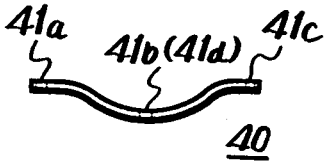
FIG. 11 is a side view showing a flexible coupling member used in the second embodiment of FIG. 6.
Figure 12:
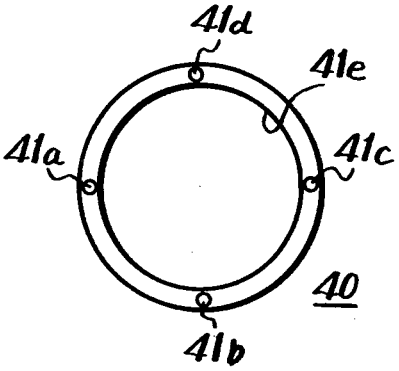
FIG. 12 is a plan view of the flexible coupling member used in the second embodiment of FIG. 6.

FIG. 6 shows a second embodiment of this invention, which uses a flexible coupling member 40 different from that of the first embodiment. The coupling member 40 of this embodiment is made of a resilient plate such as a metal in a ring shape as shown in FIGS. 11 and 12 and the shaft 3 passes through an aperture 41*e* of this annular coupling member 40 with a clearance therebetween. In addition, the coupling member 40 is provided with a corrugated shape along its periphery, that is, in this example, there are formed two tops and two troughs located between these tops, which are equally spaced alternately, so that the annular coupling member 40 may bend in a direction perpendicular to its surface or in an axial direction of the shaft 3 and also in a direction perpendicular to the shaft 3. The coupling member 40 is provided with screw bores 41*a* to 41*d*, respectively, at the substantially center of each top and trough thereof as shown in FIG. 12.

The flexible coupling member 40 mentioned above is disposed in the dial apparatus so as to indirectly act on the shaft 3 to adjust its eccentricity when the shaft 3 is rotate as in the first embodiment. The details for the above will be further described with reference to FIG. 6.

The top of the dial is covered with a suitable cover member 5*a*. The knob 5 of this dial apparatus has disposed within its aperture 24 an upper sleeve 42 having an aperture 24' through which the shaft 3 passes with a clearance, for example, about 0.1 mm therebetween and a lower sleeve 43 through which the shaft 3 passes freely. In other words, the upper sleeve 42 is bonded co-axially to the inner peripheral surface of the knob 5 by, for example, adhesive agent, while the lower sleeve 43 is fixed integrally with the shaft 3 by screws 45 from three directions through three side holes 44 of the knob 5. That is, the shaft 3 is inserted into the upper sleeve 42 with a clearance but engaged with the lower sleeve 43 in a closely contacting manner. With the above arrangement, the coupling member 40 is disposed between both the upper and lower sleeves 42 and 43 in such a manner that, for example, its two tops are fixed to the lower end surface of the upper sleeve 42 by screws 46 through, for example, the screw bores 41*a* and 41*c*, while its two troughs are fixed to the upper end surface of the lower sleeve 43 by screws 46 through the screw bores 41*b* and 41*d*. Thus, both the sleeves 42 and 43 are resiliently coupled by the flexible coupling member 40.

Figure 8:
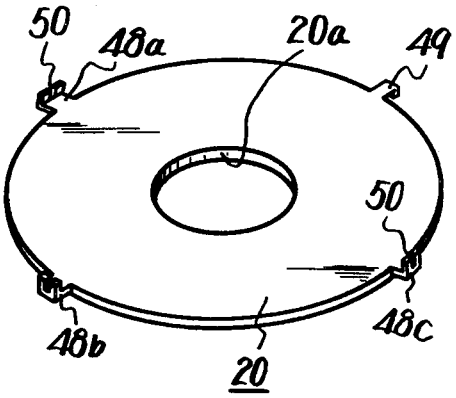
FIG. 8 is a perspective view showing a fixing plate used in the second embodiment of FIG. 6.
Figure 10:
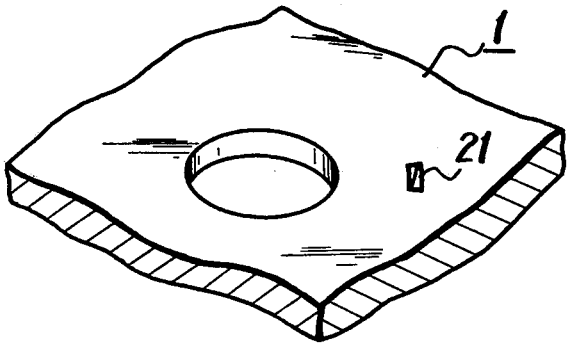
FIG. 10 is a perspective view showing the main part of a panel used in the second embodiment of FIG. 6.
Figure 9:
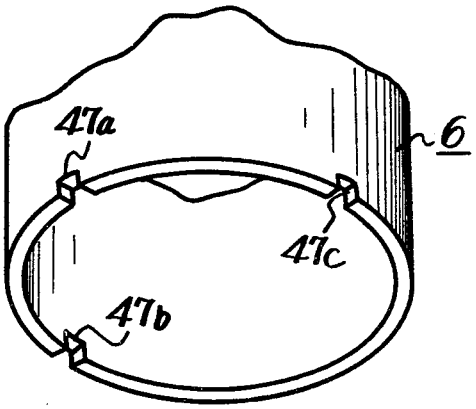
FIG. 9 is a perspective view showing the bottom portion of a bed of the second embodiment of FIG. 6.

As shown in FIGS. 7 to 10, particulary in FIG. 9, the bed 6 has provided at its bottom, for example, three recesses 47*a* to 47*c* at an angular interval of substantially 90° with one vacancy. While, as shown in FIG. 8, the fixing plate 20 is annularly formed with an aperture 20*a* through which the shaft collar 4 passes. The outer peripheral edge of this fixing plate 20 is radially extended at a same angular interval, for example, at four portions, and three portions out of them corresponding to the recesses 47*a* to 47*c* of the bed 6 are bent upward to form three up-hooks 48*a* to 48*c* while the remaining portion is downward bent to form a down-hook 49. The up-hooks 48*a* to 48*c* and down-hook 49 are each provided with a slit 50 thereby to divide each of them into two parts in the axial direction of the shaft 3 in order to provide them with resiliency. As described above, the shaft collar 4 passes through the aperture 20*a* of the fixing plate 20. The down-hook 49 of the fixing plate 20 is inserted into the hole 21 provided in the panel 1 to be secured to it while the uphooks 48*a* to 48*c* of the fixing plate 20 are respectively engaged to the corresponding recesses 47*a* to 47*c* of the bed 6. With the above arrangement, as shown in FIG. 6 the fixing plate 20 and the collar 4 are screwed to the panel 1 by the hub nut 70 thereby to fix the bed 6 onto the panel so as not to be rotatable. Thus, the positioning of the bed 6 to the panel 1 is achieved.

The dial apparatus shown in FIG. 6 is equipped with the internal mechanism, though not shown in detail, where the number of rotation of the knob 5 and its rotation angle are respectively displayed similarly as in the dial apparatus of the first embodiment.

According to the second embodiment of the dial apparatus described above, in the same manner as the first embodiment, the rotation of the knob 5 is transferred through the upper sleeve 42 and the coupling member 40 to the lower sleeve 43 thereby to rotate the shaft 3 which is secured to the sleeve 43 with the result that the resistance of the potentiometer 2 can be adjusted. With the second embodiment mentioned above, even if the shaft 3 and the knob 5 are eccentric to each other, the lower sleeve 43 is free within the aperture 24 and the shaft 3 is free within the aperture 24' of the upper sleeve 42, so that when the knob 5 is rotated the shaft 3 is also smoothly rotated. Besides, since the positioning of the bed 6 to the panel 1 can be effected only by engaging the up-hooks 48*a* to 48*c* to the recesses 47*a* to 47*c* of the bed 6 and the down-hook 49 into the hole 21 of the bed 1, the assembly is quite simple and easy. In other words, the same operation and effect as those of the first embodiment are performed in this embodiment, too.

Figure 13:
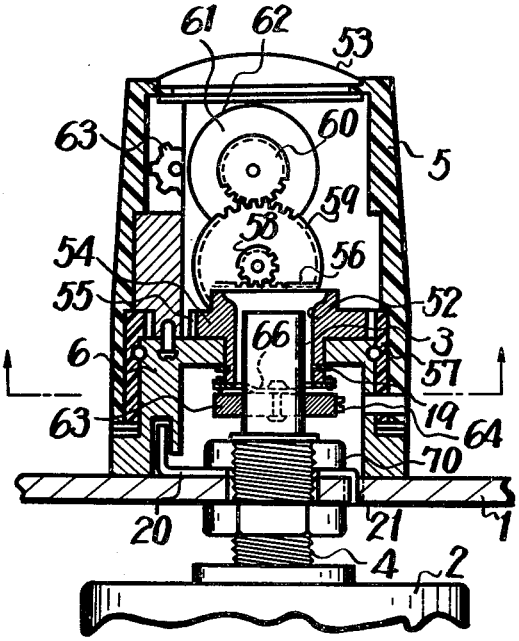
FIG. 13 is a vertical sectional view showing a digital-display dial apparatus applied with the second embodiment of this invention.

FIG. 13 shows another example wherein the aforesaid second embodiment is applied to a dial apparatus different from the foregoing, that is, the second embodiment of this invention is used in a digital-display rotary dial apparatus in which the rotating extent of the shaft 3 of the potentiometer 2 can be viewed in a digital manner. The construction of the above will be described with reference to the drawing. The knob 5 is formed in a cylinder shape with a lens 53 attached to its upper opening. The bed 6 fixedly mounted on the panel 1 by the fixing plate 20 as described above is rotatably and coaxially engaged therein with a cylinder 54. The cylinder 54 has an inner aperture 52 through which the shaft 3 is rotatably held with a clearance therebetween as in the first embodiment, and fixed by the snap ring 19 to prevent it from being axially moved. In addition, the cylinder 54 is provided along its outer peripheral surface with teeth 55 to make the whole member a rotary gear and also on its upper surface with a crown gear 56. Further, the inner aperture 52 of the cylinder 54 has a diameter larger than the outer diameter of the shaft 3 so that the latter can pass through the former with a clearance therebetween as mentioned above.

On the other hand, the knob 5 has integrally attached at its inner surface a driving gear 57 which is in mesh with the teeth 55 of the cylinder 54 so that the rotation of the knob 5 is transmitted through the driving gear 57 to the cylinder 54 to rotate the same. The knob 5 has also disposed therein a pinion 58 which is in mesh with the crown gear 56, an idler gear 59 which is co-axially integral with the pinion 58, another pinion 60 which is meshed with the gear 59, and a display wheel 61 which is co-axially integral with the pinion 60, respectively. Accordingly, when the knob 5 is now rotated, the cylinder 54 is rotated in association with the former to rotate the pinion 58 in mesh with the crown gear 56, then the idler gear 59 is rotated to drive the pinion 60 in mesh with the gear 59, and hence the display wheel 61 is rotated to change a scale 62 provided on the exterior peripheral surface of the display wheel 61. By looking at the scale 62 through the lens 53 the rotating extent of the knob 5 can be noticed. In this case, when the shaft 3 rotates beyond the indication of the scale 62, another display device, though not shown, can be provided to display the above excessive rotation. Reference numeral 63 designates a gear which rotates one tooth at every one rotation of the display wheel 61. With the provision of another display wheel (not shown) in mesh with the gear 63, the rotation beyond the indication of scale 62 of the display wheel 61 can also be displayed. It will be apparent that the dispaly of multiple figures can be carried out by adding a similar gear and display wheel.

Figure 14:
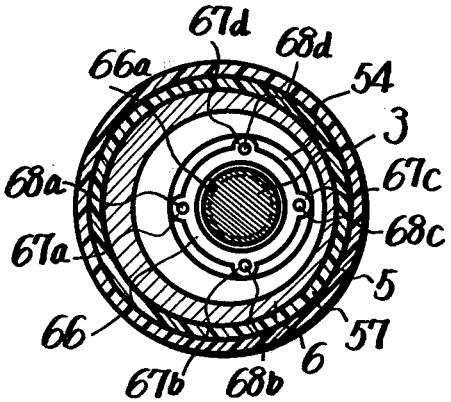
FIG. 14 is a cross sectional view taken along a line C—C of FIG. 13.

Further, below the cylinder 54, the shaft 3 is integrally secured to a ring 63 by a set screw 64. Meanwhile, there is provided a flexible coupling member 66 having an aperture 66*a* through which the shaft 3 passes freely. The coupling member 66 is substantially the same as the corrugated resilient coupling member 40 shown in FIGS. 11 and 12. However, as shown in FIG. 14 the outer peripheral edge of the coupling member 66 is outward projected at, for example, four positions, which are equally spaced from each other, to form four projections 67*a* to 67*d* each having therein a screw hole 68*a* to 68*d*. The coupling member 66 as mentioned above is coupled to the cylinder 54 and the ring 63 at its four screw holes 68*a* to 68*d* in the same manner as the previous embodiment of this invention. Accordingly, when the knob 5 is rotated, the cylinder 54 is rotated and hence the ring 63 is rotated through the coupling member 66 to rotate the shaft 3, thus the resistance value of the potentiometer 2 being adjusted. The number of rotation of the shaft 3 and its rotational angle are displayed on the scale 62 of the display wheel 61 which is visible through the lens 53.

With the dial apparatus shown in FIG. 13, even though the knob 5 and the shaft 3 passing through the panel 1 are eccentric therebetween, the roomy shaft aperture 52 of the cylinder 54 and the coupling member 66 allow easy assembly of component members and smooth rotation of the shaft 3.

It will be apparent that the rotary support device of this invention is applicable to a dial apparatus other than the foregoing apparatus.

While a few embodiments of this invention have been illustrated and described in detail, it is particularly understood that the invention is not limited thereto or thereby.

I claim as my invention:

1. A rotary support device for use with a dial apparatus having a rotary shaft comprising:

(a) a first support member (1 and 2) having an aperture through which a rotary shaft of a dial apparatus passes;

(b) means for fixedly attaching said rotary shaft to said first support member (70);

(c) a second support member (5 and 42) having an aperture for rotatably receiving said rotary shaft therein, the inner diameter of said aperture of second support member being selected greater than the outer diameter of said rotary shaft so that said rotary shaft can be rotated in said second support member with a clearance therebetween;

(d) means fixed on said shaft of said dial apparatus for rotatably supporting said second support member (43);

(e) a rotary member of said dial apparatus rotatably supported by said fixed means and fixed to said second support member 18; and (f) a ring-shaped coupling member which is corrugated such that it has at least two high points and two troughs and said high points fixed to said second support member and said troughs fixed to said means fixed on said shaft for resiliently coupling said second support member to said means fixed on said shaft with a gap therebetween; whereby when said rotary member of said dial apparatus is rotated, the rotation of said rotary member is transmitted through said second support member, ring-shaped coupling member and means fixed on said rotary shaft to rotate said rotary shaft.

2. A rotary support device as claimed in claim 1, in which said coupling member consists of a resilient ring which has formed therethrough an aperture through which said rotary shaft passes and said ring is fixed to said second support member and to said means fixed on said shaft at alternately separated positions.

3. A rotary support device as claimed in claim 2, in which said ring-shaped member is fixed to said means fixed on said shaft at the troughs of the corrugation and to said second support member at the high points of said corrugation.

4. A rotary support device as claimed in claim 3, in which the high points and troughs of said ring-shaped member are evenly spaced apart.

5. A rotary support device as claimed in claim 1, in which said clearance between said rotary shaft and said second support member is about 0.1 mm.

* * * * *